US008890438B2

(12) United States Patent
Wang et al.

(10) Patent No.: US 8,890,438 B2
(45) Date of Patent: Nov. 18, 2014

(54) LIGHT-EMITTING DIODE DRIVING DEVICE, LIGHT-EMITTING DIODE DEVICE, AND METHOD FOR DRIVING THE SAME

(75) Inventors: Sih-Ting Wang, Kaohsiung (TW); Chung-Wen Wu, Yilan County (TW); Chien-Cheng Tu, Hsinchu (TW); Chia-Chun Liu, Hsinchu County (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 776 days.

(21) Appl. No.: 13/047,806

(22) Filed: Mar. 15, 2011

(65) Prior Publication Data

US 2012/0086359 A1 Apr. 12, 2012

(30) Foreign Application Priority Data

Oct. 6, 2010 (TW) ..... 99134018 A

(51) Int. Cl.
*H05B 37/02* (2006.01)
*H05B 33/08* (2006.01)

(52) U.S. Cl.
CPC ..... *H05B 33/0827* (2013.01); *H05B 33/089* (2013.01)
USPC ..... 315/307; 315/209 R

(58) Field of Classification Search
USPC ..... 315/200 R, 209 R, 224, 225, 291, 307
See application file for complete search history.

(56) References Cited

U.S. PATENT DOCUMENTS

| | | | | |
|---|---|---|---|---|
| 2007/0182347 | A1 | 8/2007 | Shteynberg | |
| 2009/0128055 | A1 * | 5/2009 | Shin et al. | 315/301 |
| 2011/0148323 | A1 * | 6/2011 | Yao et al. | 315/295 |

FOREIGN PATENT DOCUMENTS

| | | | |
|---|---|---|---|
| CN | 101080119 | A | 11/2007 |
| CN | 101325029 | A | 12/2008 |
| CN | 101730331 | A | 6/2010 |
| CN | 101778508 | A | 7/2010 |
| TW | 200618671 | | 6/2006 |

* cited by examiner

*Primary Examiner* — Jimmy Vu
(74) *Attorney, Agent, or Firm* — Winston Hsu; Scott Margo

(57) ABSTRACT

A light-emitting diode driving device includes a light-emitting diode driving chip, for driving the one or more light-emitting diode strings according to a feedback voltage associated with the one or more light-emitting diode strings, and a voltage limiter, having a terminal coupled to the light-emitting diode driving chip and another terminal coupleable to the one or more light-emitting diode strings, for generating the feedback voltage for provision to the light-emitting diode driving chip according to a bottom voltage of the one or more light-emitting diode strings, and limiting the feedback voltage not to exceed a preset level.

13 Claims, 5 Drawing Sheets

LIGHT-EMITTING DIODE DRIVING DEVICE, LIGHT-EMITTING DIODE DEVICE, AND METHOD FOR DRIVING THE SAME

BACKGROUND OF THE INVENTION

1. Field of the Invention

The disclosure relates to LED driving techniques, and more particularly, to an LED driving device, LED device and driving method thereof capable of avoiding being damaged by high voltage.

2. Description of the Prior Art

Due to environmental concerns and technology advancements in recent years, light-emitting diodes (LEDs) have gradually replaced cold cathode fluorescent lamps (CCFLs) as screen backlights of computers and TVs.

Please refer to FIG. 1, which is a schematic diagram of a conventional LED device 10. The LED device 10 includes an LED string C1 and an LED driving chip 102. The LED driving chip 102 includes an LED driving circuit 104, a short detection circuit 106 and a boost circuit 108, for driving, performing short detection on, and providing a boost voltage Vbst for the LED string C1, respectively. Noticeably, FIG. 1 only illustrates one LED string, one short detection circuit and one driving circuit for simplicity. However, the LED device 10 can practically include a plurality of LED strings connected in parallel, a plurality of short detection circuits, and a plurality of driving circuits. Each of the plurality of LED strings is similar to the LED string C1, and is driven, monitored for shorts and provided with a boost voltage by the corresponding driving circuit, short detection circuit and boost circuit of the LED driving chip 102.

In detail, during normal operation, the LED driving circuit 104 generates a control signal Sctrl according to a feedback voltage Vfb from LED string C1, i.e. a bottom voltage Vbtm of LED string C1, and provides the control signal Sctrl to the boost circuit 108. Then, the boost circuit 108 adjusts the boost voltage Vbst according to the control signal Sctrl, so as to keep the feedback voltage Vfb and the boost voltage Vbst, around 20-60V, within a reasonable range. However, under some circumstances, e.g. when the LED driving circuit 104 controls the LED string C1 to blink, or the short detection circuit 106 detects an LED short, the LED driving circuit 104 cuts off a driving current Id of the LED string C1, such that the bottom voltage Vbtm of the LED string C1 rises to the boost voltage Vbst, i.e. the feedback voltage Vfb rises to the same high voltage level as the boost voltage Vbst.

The conventional LED driving chip 102 is manufactured in a high operating voltage process, so the LED driving circuit 104 can receive the high voltage level without being damaged. However, due to a current trend toward system on chip (SOC) architectures, the LED driving chip is increasingly integrated with image processing circuits, and is also manufactured in a low operating voltage process with an operating voltage no higher than 5V to achieve higher operating speed. Thus, in consideration of high possibility that a low operating voltage chip is burned out when receiving a high voltage, there is a need for improvement of the prior art to adapt to the trend toward low-voltage single chips.

SUMMARY OF THE INVENTION

It is therefore one of the objectives to provide a LED driving device, LED device and driving method thereof, which can avoid high voltage directly entering chip and thus burning the chip, so as to adapt to the trend towards low-voltage single chips.

In an embodiment, a light-emitting diode (LED) driving device is disclosed. The LED driving device includes an LED driving chip, for driving one or more LED strings according to a feedback voltage associated with the one or more LED strings, and a voltage limiter, having a terminal coupled to the LED driving chip and another terminal couplable to the one or more LED strings, for generating the feedback voltage for provision to the LED driving chip according to a bottom voltage of the one or more LED strings, and limiting the feedback voltage not to exceed a preset level.

Besides, in another embodiment, a light-emitting diode (LED) device is further disclosed. The LED device includes one or more LED strings, and the above LED driving device, for driving the one or more LED strings.

In a further embodiment, a driving method for a light-emitting diode (LED) device is further disclosed. The driving method includes steps of generating a feedback voltage according to a bottom voltage of one or more LED strings, and limiting the feedback voltage not to exceed a preset level, and driving the one or more LED strings according to the feedback voltage of the one or more LED strings.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
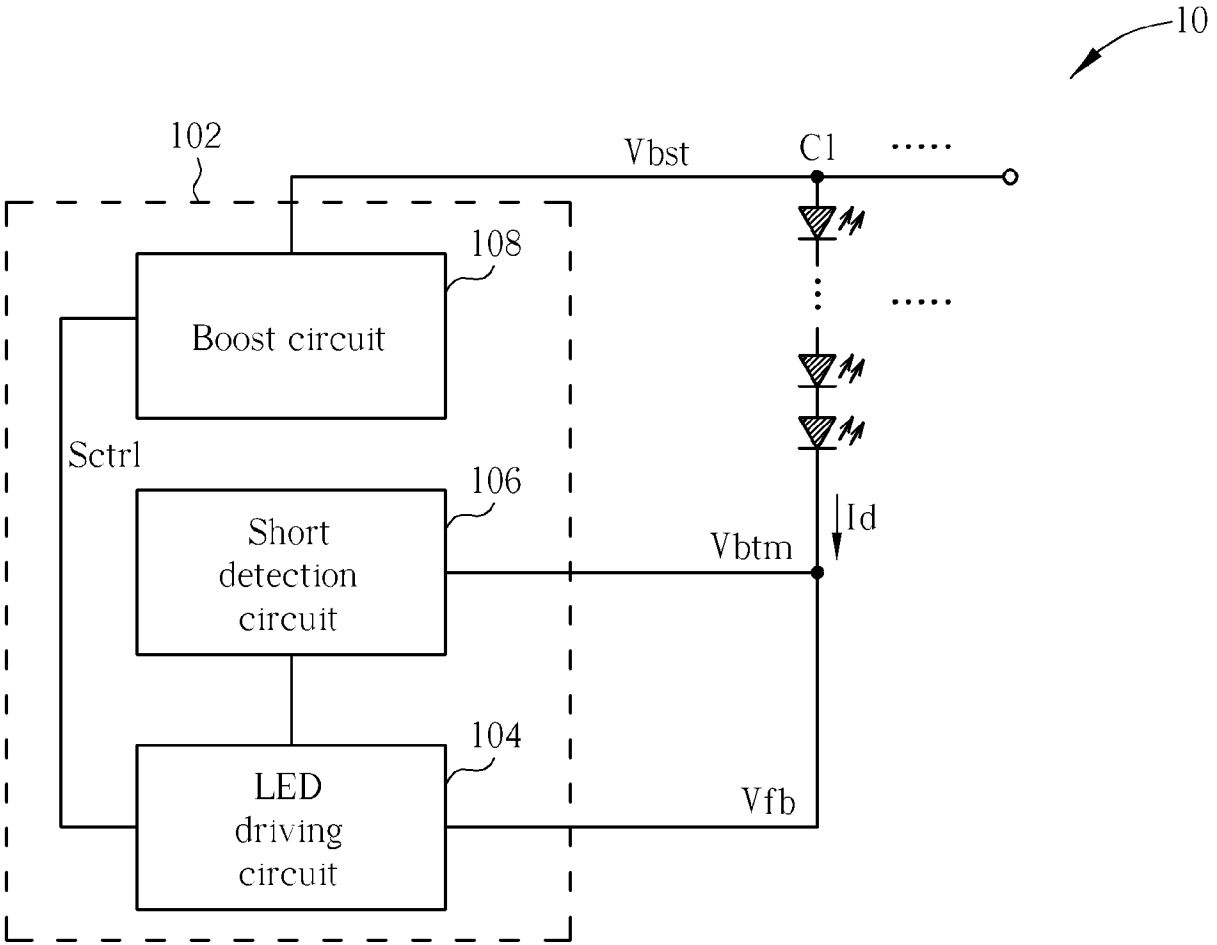
FIG. 1 PRIOR ART
FIG. 1 is a schematic diagram of a conventional LED device.
Figure 2:
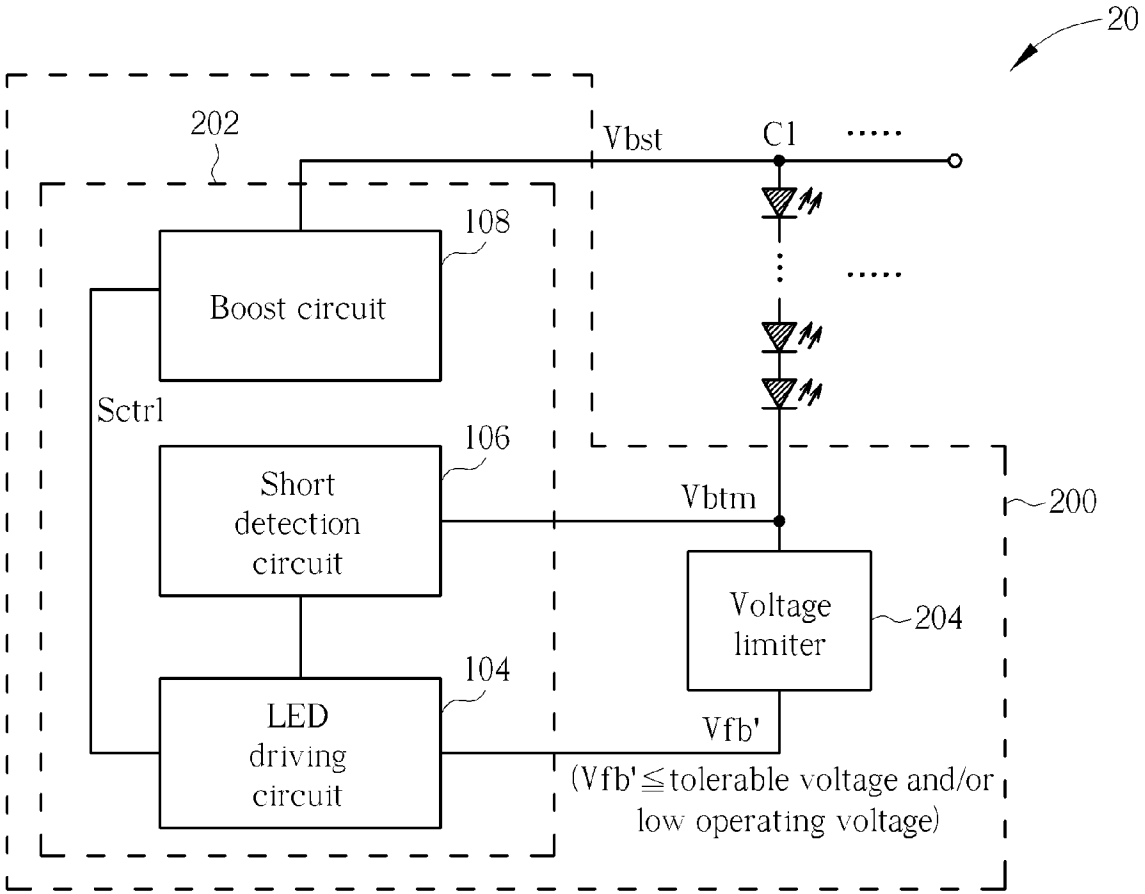
FIG. 2 is a schematic diagram of a structure of a LED device according to an embodiment.

Please refer to FIG. 2, which is a schematic diagram of a structure of a light-emitting diode (LED) device 20 according to an embodiment. The structure and operations of the LED device 20 are partially similar to those of the LED device 10, and thus elements and signals with the same functions are denoted by the same symbols for simplicity. The LED device 20 mainly includes the LED string C1 and an LED driving device 200. The LED driving device 200 is coupled to the LED string C1 so as to drive it. A main difference between the LED device 20 and the LED device 10 is that the LED device 20 further includes a voltage limiter 204, which has a terminal coupled to the LED driving circuit 104 of an LED driving chip 202 and another terminal externally coupled to the LED string C1. In a preferred embodiment, the LED driving chip 202 is realized as a low operating voltage chip while the voltage limiter 204 is embedded in a high operating voltage chip. Moreover, the low voltage chip and the high voltage chip can be integrated into the LED driving device 200.

The voltage limiter 204 is configured to receive the bottom voltage Vbtm of the LED string C1 so as to generate a feedback voltage Vfb' for provision to the LED driving circuit 104 in the LED driving chip. The boost circuit 108 can then adjust the boost voltage Vbst according to the feedback voltage Vfb', and provide the boost voltage Vbst to an end (e.g., a top end)

of the LED string C1. The voltage limiter 204 also limits the feedback voltage Vfb' not to exceed (i.e. less than or equal to) a preset level. Preferably, the preset level is set not to exceed a maximum voltage the LED driving chip 202 can tolerate without being burnt, namely, a tolerable voltage. More preferably, the preset level is set not to exceed a low operating voltage Vlp of the LED driving chip 202.

In other words, different from the conventional LED device 10 that directly utilizes the bottom voltage Vbtm as the feedback voltage Vfb without any limitation to the feedback voltage Vfb, the feedback voltage Vfb' of the LED device 20 is limited by the voltage limiter 204 not to exceed a preset level. As a result, the voltage limiter 204 can prevent the LED driving circuit 104 from receiving high voltage and thus prevent the LED driving chip 202 from being damaged.

In a specific embodiment, the voltage limiter 204 activates the limiting function according to the bottom voltage Vbtm. Specifically, when a driving current is not cut off, the bottom voltage Vbtm is not high enough to activate the limiting function of the voltage limiter 204. Therefore, the voltage limiter 204 can directly output the bottom voltage Vbtm as the feedback voltage Vfb'. On the other hand, when the driving current is cut off to cause the bottom voltage Vbtm to rise too high (within a range), the voltage limiter 204 starts limiting the feedback voltage Vfb', keeping it substantially at the preset level, which can be designed not to exceed the tolerable voltage or the low operating voltage Vlp. As a result, no matter whether the driving current is cut off or not, the feedback voltage Vfb' does not exceed the tolerable voltage or the low operating voltage Vlp.

Figure 3:
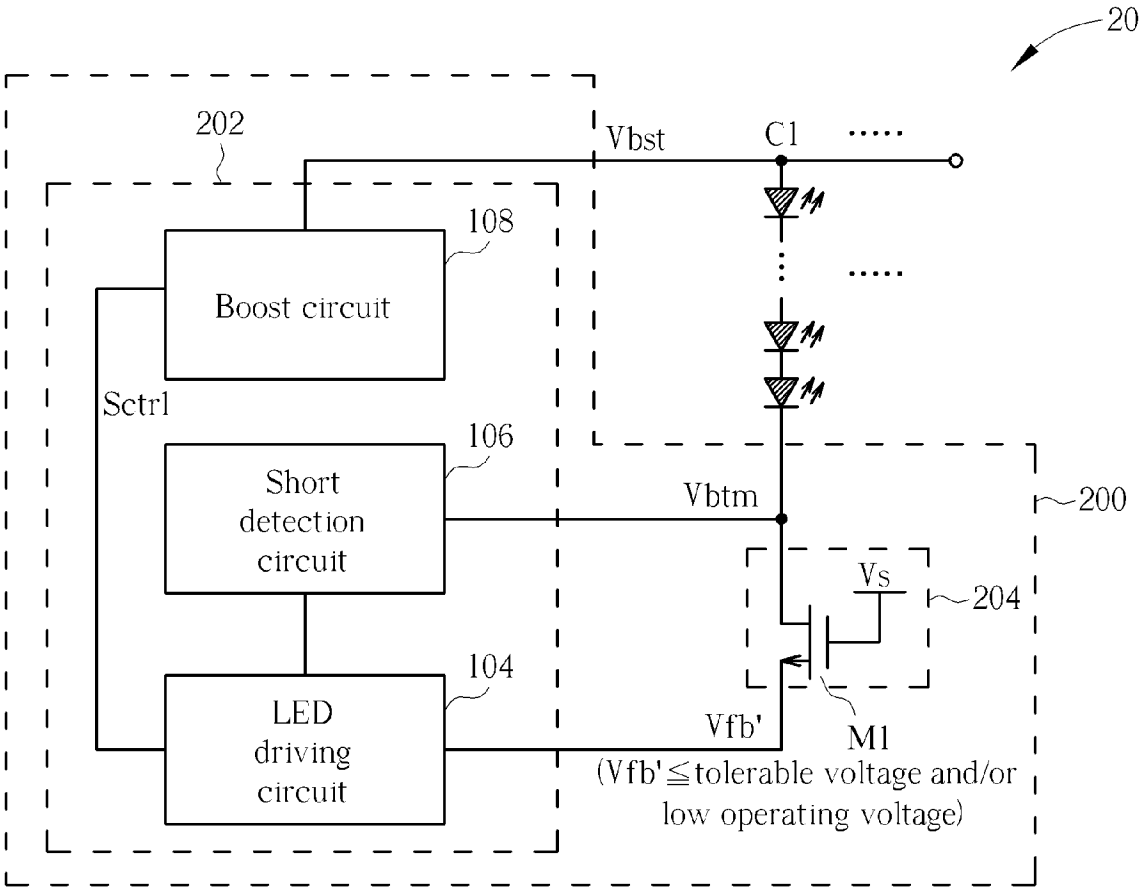
FIG. 3 is a schematic diagram of a detailed circuit of the LED device shown in FIG. 2 according to an embodiment.
Figure 4:
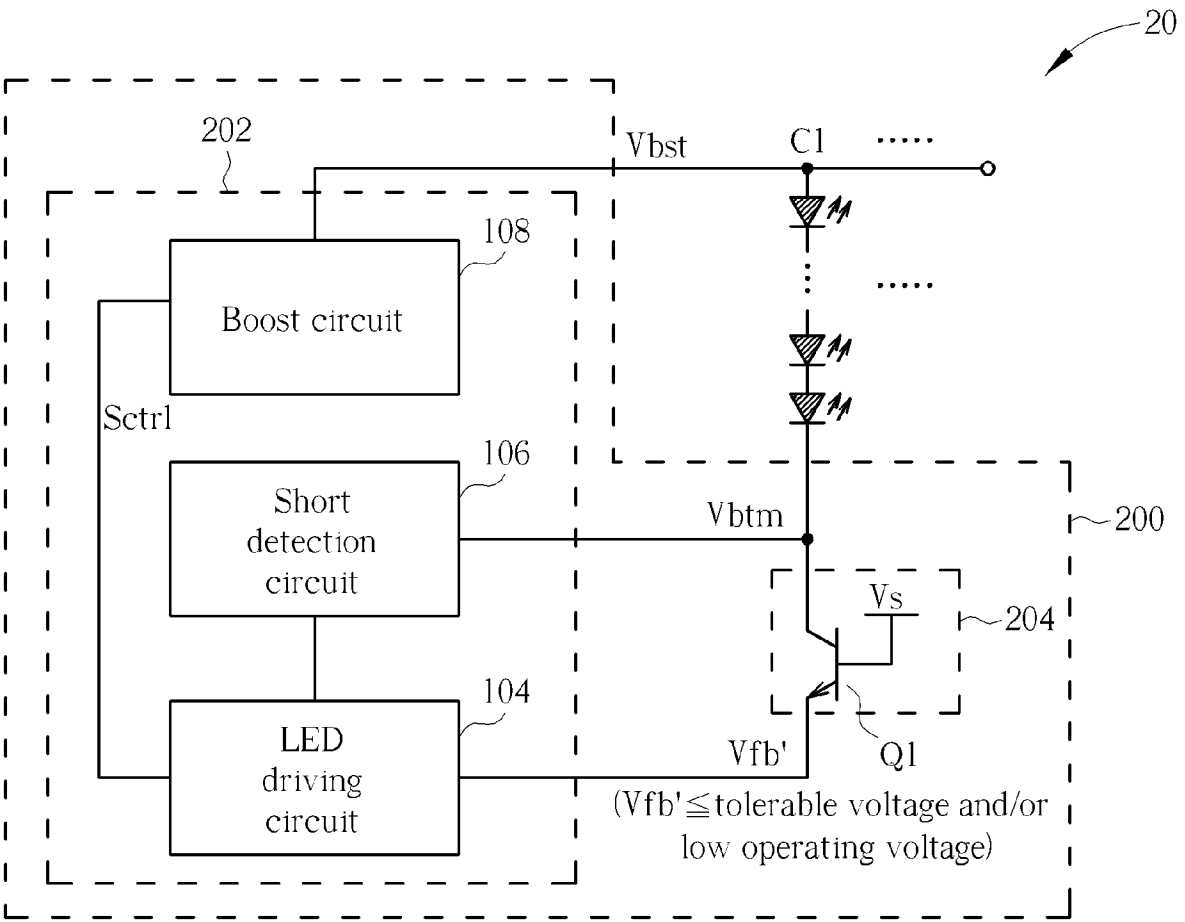
FIG. 4 is a schematic diagram of a detailed circuit of the LED device shown in FIG. 2 according to another embodiment.

In FIG. 2, realizations of the voltage limiter 204 are not limited to specific structures and operations. A variety of circuits with different structures can be utilized for realizing the voltage limiter 204. FIG. 3 and FIG. 4 illustrate detailed structures and operations of the voltage limiter 204 according to different embodiments.

In detail, please refer to FIG. 3, which is a schematic diagram of a detailed circuit of the LED device 20 shown in FIG. 2 according to an embodiment. As can be seen from FIG. 3, the voltage limiter 204 is realized by a high voltage metal oxide semiconductor (MOS) transistor M1, e.g. NMOS, coupled between the LED driving chip 202 and the LED string C1. The high voltage MOS transistor M1 includes a drain coupled to a negative terminal of the LED string C1 to receive the bottom voltage Vbtm (i.e. a drain voltage equal to the bottom voltage Vbtm), a source coupling the LED driving chip 202 to output the feedback voltage Vfb' (i.e. a source voltage equal to the feedback voltage Vfb'), and a gate to which a specific voltage Vs is applied.

When a gate voltage (the specific voltage Vs) is greater than a sum of a source voltage (the feedback voltage Vfb') and a threshold voltage Vth, i.e. Vs>Vfb'+Vth, where Vth can be about 2V, the high voltage NMOS transistor M1 is turned on. Therefore, when the driving current is not yet cut off, the high voltage NMOS transistor M1 stays turned-on, directly outputting the bottom voltage Vbtm as the source voltage of the high voltage NMOS transistor M1 (the feedback voltage Vfb'). Conversely, when the driving current is cut off to cause the bottom voltage Vbtm to rise, the source voltage rises correspondingly until the source voltage equals a level of the gate voltage minus the threshold voltage Vth, that is, until the high voltage NMOS transistor M1 starts to be turned off. In other words, the specific voltage Vs minus the threshold voltage Vth of FIG. 3 is equal to the preset level described in connection with FIG. 2, and can be designed to be less than or equal to the tolerable voltage or the low operating voltage Vlp of the LED driving chip 202. For example, when the low operating voltage Vlp is 3.3V, the specific voltage Vs can be set to be 5V, such that the feedback voltage Vfb' does not exceed 3V (5V-2V) and thus does not exceed 3.3V. As a result, even if the driving current is cut off to cause the bottom voltage Vbtm to rise too high, the feedback voltage Vfb' received by the LED driving chip 202 still does not exceed the tolerable voltage or the low operating voltage Vlp, and the LED driving chip 202 is not burnt. Noticeably, the above embodiment only utilizes the one high voltage NMOS transistor M1 as an example, but other embodiments may apply one or more coupled PMOS or NMOS transistors or even incorporate other resistance elements to realize the voltage limiter 204.

Please refer to FIG. 4, which is a schematic diagram of a detailed circuit of the LED device 20 shown in FIG. 2 according to another embodiment. A main difference between FIG. 4 and FIG. 3 is that the voltage limiter 204 is realized by a high voltage bipolar junction transistor (BJT) Q1, e.g. an NPN BJT. Similar to the high voltage NMOS transistor M1 shown in FIG. 3, when a base voltage is greater than a sum of an emitter voltage and a forward source-to-emitter voltage, the high voltage NPN BJT Q1 is turned on. Therefore, even if the driving current is cutoff to cause the bottom voltage Vbtm to rise too high, the feedback voltage Vfb' received by the LED driving chip 202 still does not exceed the tolerable voltage or the low operating voltage Vlp, and the LED driving chip 202 is not burnt. Noticeably, the above embodiment only utilizes the one high voltage NPN BJT Q1 as an example, but other embodiments may apply one or more coupled NPN BJTs or PNP BJTs, or even incorporate other resistance elements to realize the voltage limiter 204.

Noticeably, in FIG. 2, the voltage limiter 204 performs voltage limiting operations, and realizations thereof are not limited to a specific rule. Those skilled in the art may make modifications or alterations accordingly, which are not limited to the structures and operations shown in FIG. 3 and FIG. 4.

Noticeably, similar to FIG. 1, FIG. 2 to FIG. 4 only illustrate one LED string, one clamp circuit, one short detection circuit, one limiter and one driving circuit for simplicity, respectively. However, the LED device 20 can practically include at least one set of LED strings, one or more short detection circuits, one or more limiters and one or more driving circuits. Each set of LED strings, including one or more LED strings, can be driven by the corresponding driving circuit of the LED driving chip 202, monitored for shorts by the corresponding clamp circuit, and have its voltage limited by the corresponding limiter. Detailed structures and operations are similar with the above description, and are not narrated hereinafter.

Figure 5:
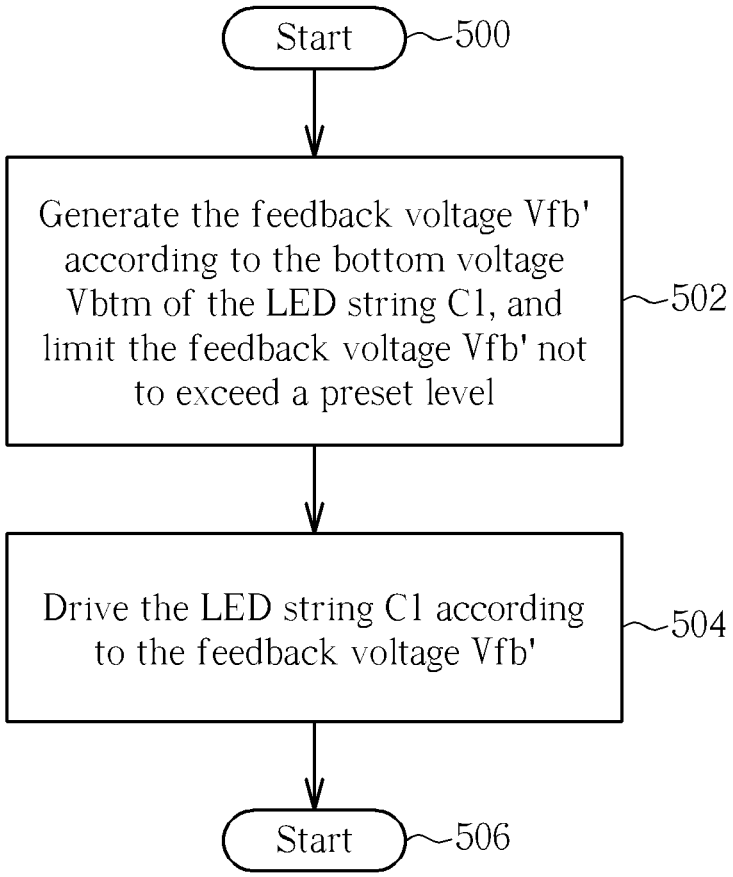
FIG. 5 is a schematic diagram of a driving process of an LED device according to an embodiment.

The operations of the LED device 20 can be summarized into a driving process 50 as shown in FIG. 5. The driving process 50 includes the following steps:

Step 500: Start.

Step 502: Generate the feedback voltage Vfb' according to the bottom voltage Vbtm of the LED string C1, and limit the feedback voltage Vfb' not to exceed a preset level.

Step 504: Drive the LED string C1 according to the feedback voltage Vfb'.

Step 506: End.

Details of each step can be derived by referring to operations of corresponding elements of the LED device 20, and are not narrated hereinafter.

The driving process 50 of the above embodiment limits the feedback voltage instead of directly receiving high voltage, so as to prevent the LED driving chip from being damaged when the driving current is cut off. In more detail, the above embodiment limits the feedback voltage Vfb', such that the feedback voltage Vfb' is less than the tolerable voltage or the low operating voltage Vlp of LED driving chip. Therefore, even if the driving current is cut off to cause the bottom voltage Vbtm to rise too high, the feedback voltage Vfb' is still maintained at a low voltage. As a result, the driving process 50 can prevent the LED driving chip from being damaged when the driving current is cut off.

To sum up, due to the current trend toward SOCs and requirements for high operating speed, the LED driving chip is integrated with image processing circuits, and is manufactured in a low operating voltage process. However, the prior art directly receives the bottom voltage Vbtm as the feedback voltage Vfb, and thus when the driving current of the LED string C1 is cut off and the feedback voltage Vfb rises too high, the high voltage enters the chip and damages the chip. In comparison, the above embodiments include a voltage limiter for limiting the feedback voltage, so as prevent the high voltage from directly entering the chip and causing the chip to be burnt. As a result, the above embodiments can adapt to the trend towards the low-voltage single chip.

Those skilled in the art will readily observe that numerous modifications and alterations of the device and method may be made while retaining the teachings of the invention.

What is claimed is:

1. A light-emitting diode (LED) driving device, comprising:

an LED driving chip, for driving one or more LED strings according to a feedback voltage associated with the one or more LED strings; and a voltage limiter, having a terminal coupled to the LED driving chip and another terminal couplable to the one or more LED strings, for generating the feedback voltage for provision to the LED driving chip according to a bottom voltage of the one or more LED strings, and limiting the feedback voltage not to exceed a preset level;

wherein the voltage limiter comprises a high voltage metal oxide semiconductor (MOS) transistor, coupled between the one or more LED strings and the LED driving chip, and having a gate for receiving a specific voltage, and the feedback voltage does not exceed the specific voltage minus a threshold voltage of the high voltage MOS transistor.

2. The LED driving device of claim 1, wherein the LED driving chip further adjusts a boost voltage according to the feedback voltage, and provides the boost voltage to an end of the one or more LED strings.

3. The LED driving device of claim 1, wherein the preset level does not exceed one of a low operating voltage and a tolerable voltage of the LED driving chip.

4. The LED driving device of claim 1, wherein the voltage limiter limits the feedback voltage after a driving current received by the one or more LED strings is cut off and the bottom voltage rises.

5. The LED driving device of claim 1, wherein the voltage limiter starts limiting the feedback voltage to substantially the preset level when the bottom voltage rises to the preset level.

6. A light-emitting diode (LED) device, comprising:

one or more LED strings; and the LED driving device of claim 1, for driving the one or more LED strings.

7. A driving method for a light-emitting diode (LED) device, comprising:

generating a feedback voltage according to a bottom voltage of one or more LED strings, and limiting the feedback voltage not to exceed a preset level; and driving the one or more LED strings according to the feedback voltage of the one or more LED strings;

wherein the step of generating the feedback voltage comprises:

coupling a terminal of a high voltage metal oxide semiconductor (MOS) transistor to the one or more LED strings, and generating the feedback voltage from another terminal of the high voltage MOS transistor; and providing a specific voltage to a gate of the high voltage MOS transistor;

wherein the feedback voltage does not exceed the specific voltage minus a threshold voltage of the high voltage MOS transistor.

8. The driving method of claim 7, wherein the step of driving the one or more LED strings comprises adjusting a boost voltage according to the feedback voltage, and providing the boost voltage to an end of the one or more LED strings.

9. The driving method of claim 7, wherein the step of limiting the feedback voltage comprises limiting the feedback voltage not to exceed one of a low operating voltage and a tolerable voltage of the LED driving chip.

10. The driving method of claim 7, wherein the step of limiting the feedback voltage is performed after a driving current received by the one or more LED strings is cut off and the bottom voltage rises.

11. The driving method of claim 7, wherein the step of limiting the feedback voltage comprises starting limiting the feedback voltage to substantially the preset level when the bottom voltage rises to the preset level.

12. A light-emitting diode (LED) driving device, comprising:

an LED driving chip, for driving one or more LED strings according to a feedback voltage associated with the one or more LED strings; and a voltage limiter, having a terminal coupled to the LED driving chip and another terminal couplable to the one or more LED strings, for generating the feedback voltage for provision to the LED driving chip according to a bottom voltage of the one or more LED strings, and limiting the feedback voltage not to exceed a preset level;

wherein the voltage limiter comprises a high voltage bipolar junction transistor (BJT), coupled between the one or more LED strings and the LED driving chip, and having a base for receiving a specific voltage, and the feedback voltage does not exceed the specific voltage minus a forward source to emitter voltage of the high voltage BJT.

13. A driving method for a light-emitting diode (LED) device, comprising:

generating a feedback voltage according to a bottom voltage of one or more LED strings, and limiting the feedback voltage not to exceed a preset level; and driving the one or more LED strings according to the feedback voltage of the one or more LED strings;

wherein the step of generating the feedback voltage comprises:

coupling one terminal of a high voltage bipolar junction transistor (BJT) to the one or more LED strings, and generating the feedback voltage from another terminal of the high voltage BJT; and providing a specific voltage to a base of the high voltage BJT wherein the feedback voltage does not exceed the specific voltage minus a forward source to emitter voltage of the high voltage BJT.

* * * * *